US006133170A

United States Patent [19]

Suenaga et al.

[11] Patent Number: 6,133,170

[45] Date of Patent: Oct. 17, 2000

[54] LOW DENSITY BODY

[75] Inventors: Hiroshi Suenaga, Tokyo; Yukihiro Yoshimura, Soka; Hisao Ishikawa, Tokyo, all of Japan

[73] Assignee: Oji Paper Co., Ltd., Tokyo, Japan

[21] Appl. No.: 09/010,936

[22] Filed: Jan. 22, 1998

[30] Foreign Application Priority Data

Jan. 23, 1997 [JP] Japan ..... 9-010343

[51] Int. Cl.[7] ..... D02G 3/04; D02G 3/08

[52] U.S. Cl. ..... 442/334; 442/352; 210/500.1; 162/141; 162/143; 162/146; 162/149

[58] Field of Search ..... 442/334, 352; 162/157.6, 158, 182, 109, 141, 143, 146, 148, 149; 210/500.1

[56] References Cited

U.S. PATENT DOCUMENTS

| | | |
|---|---|---|
| H1704 | 1/1998 | Wallajepet et al. . |
| 5,087,324 | 2/1992 | Awofeso et al. . |
| 5,834,095 | 11/1998 | Dutkiewicz et al. . |
| 5,843,852 | 12/1998 | Dutkiewicz et al. . |
| 5,858,021 | 1/1999 | Sun et al. . |

FOREIGN PATENT DOCUMENTS

| | | |
|---|---|---|
| 52-19152 | 5/1977 | Japan . |
| 55-23109 | 2/1980 | Japan . |
| 3-124895 | 5/1991 | Japan . |
| 3-269025 | 11/1991 | Japan . |
| 4-202895 | 7/1992 | Japan . |
| 5-339898 | 12/1993 | Japan . |
| 7-41588 | 2/1995 | Japan . |
| 9-41300 | 2/1997 | Japan . |

*Primary Examiner*—Newton Edwards
*Assistant Examiner*—J. M. Gray
*Attorney, Agent, or Firm*—Oblon, Spivak, McClelland, Maier & Neustadt, P.C.

[57] ABSTRACT

A low density body such as a sheet, board or molding usable as a cushioning material, heat-insulating material, sound-absorbing material, filter, low density base paper or the like is provided. The low density body having a density of 0.05 to 0.45 g/cm$^3$ is prepared by dewatering a slurry containing fine fibers having a bond-reinforcing factor of at least 0.15 and curled fibers having a wet curl factor of 0.4 to 1.0, and drying the resultant product.

19 Claims, No Drawings

LOW DENSITY BODY

TECHNICAL FIELD OF THE INVENTION

The present invention relates to a low density body such as a sheet, a board and a molding, which mainly comprises pulp fiber, is substantially free from the formation of edge dust, and has a high internal bond strength.

BACKGROUND OF THE INVENTION

Low density bodies are generally used in various fields, taking advantage of their light weight, cushioning properties, heat-insulating properties, sound-absorbing properties, etc. The low density bodies most generally used are foams of synthetic resin such as polystyrene, polyurethane and polyethylene. Although these bodies are excellent in strength and processability, they have a problem in that when they are left to stand in natural environment, they keep their shape because are not biodegradable and, as a result, they spoil the appearance of the site for a long period of time and cause environmental pollution. Further, when they are dumped in reclaimed land, the land is filled in a short period of time because they are not biodegradable and they are bulky.

In addition, since these bodies cause high combustion heat, the combustion temperature is high when they are burnt in an incinerator to damage the incinerator and also to shorten the life thereof.

Under these circumstances, various biodegradable low density cellulose fiber bodies which have low combustion calory have been proposed. For example, there have been proposed, a process wherein a synthetic resin is mixed with cellulose fibers and the mixture is foamed [Japanese Patent Unexamined Published Application (hereinafter referred to as "J. P. KOKAI") Nos. Sho 55-23109 and Hei 3-269025, and Japanese Patent Publication for Opposition Purpose (hereinafter referred to as "J. P. KOKOK U") No. Sho 52-19152]; a process for producing a foamed product, wherein a foaming agent having a decomposition temperature of not above 100° C. is incorporated into a composition comprising cellulose fibers compounded with a prescribed amount of a sticking agent made from an animal or plant source and an adhesive selected from among synthetic resin emulsions and rubber latices and the composition is foamed (J. P. KOKAI No. Hei 7-41588); a process for producing a sheet of paper having a low density and a high bulkiness by incorporating a granular foaming agent into cellulose fibers, making a base paper from the resultant mixture and foaming the paper by heating (J. P. KOKAI No. Hei 5-339898); bulky sheets of paper comprising cellulose fibers and calcium carbonate in the form of hollow spherical vaterite (J. P. KOKAI No. Hei 3-124895); and bulky sheets obtained by molding a mixture of a heat-fusible fibers and a crosslinked pulp obtained by reacting pulp with a crosslinking agent in the presence of a fiber-softening agent (J. P. KOKAI No. Hei 4-202895).

However, although the low density bodies obtained from the combination of cellulose fibers with the heat-fusible fibers have a high bulkiness, it has defects in that the number of the bonding points of the fibers is insufficient for obtaining a high bonding force and, therefore, the interlayer peeling easily occurs and that paper dusts are formed in the course of the production, handling and molding thereof to pollute the working atmosphere. The above-described process for obtaining the low density body by foaming with the foaming agent has defects in that the foaming cannot be easily controlled and the state of foaming is locally uneven to obtain a heterogeneous structure, and that when the foaming is excessive, the innerlayer peeling occurs to form edge dust at the peeled parts. The process wherein a non-biodegradable resin or fiber is used has the above-described problem in disposing them.

SUMMARY OF THE INVENTION

After intensive investigations on the low density bodies having excellent properties produced from, for example, biodegradable cellulose fibers as the main starting material and also on the process for producing them under these circumstances, the inventors have found that a low density body produced by removing a liquid (dewatering) from an aqueous slurry containing specific fine fibers and curled fibers as the starting materials and drying the resultant product is excellent. The present invention has been completed on the basis of this finding. The present invention has been succeeded for the following reasons: the inventors noted that although the curled fibers having a wet curl factor in the range of 0.4 to 1.0 have only a very low bonding strength to each other, the density of them can be made low very easily because a large volume of cavities can be kept therein and that the fine fibers having a bond-reinforcing factor of at least 0.15 have a strong property of making the bond between the fibers strong. Accordingly, the inventors combined these two kinds of materials each having the characteristic features. When the fine fibers of the present invention are replaced with a water-soluble, high-molecular substance such as starch, CMC, PVA or PAM, or with a styrene/butadiene or vinyl acetate latex, the yield is low and a satisfactory internal bond strength is difficultly obtained even with a large amount of such a substance.

The object of the present invention is to provide a low density body having a high internal bond strength, which scarcely forms edge dust, while keeping the density thereof low.

The low density body of the present invention is characterized by being obtained by dewatering a slurry containing fine fibers having a bond-reinforcing factor of at least 0.15 and curled fibers having a wet curl factor in the range of 0.4 to 1.0 as the starting materials and drying the resultant product, and also by having a density of 0.05 to 0.45 g/cm$^3$.

In the low density body of the present invention, the fine fibers are preferably pulp fibers.

In the low density body of the present invention, the fine fibers preferably have an arithmetic-average fiber length in the range of 0.01 to 0.80 mm, more preferably 0.05 to 0.60 mm.

The water retention value of the fine fibers of the present invention is preferably in the range of 150 to 500%.

The low density body of the present invention preferably comprises the fine fibers in an amount of 3 to 65% by weight, preferably 3 to 50% by weight, based on the total weight of the fine fibers and curled fibers. Accordingly, the body comprises the curled fibers in an amount of 35 to 97% by weight, preferably 50 to 97% by weight, based on the the total weight of the fine fibers and curled fibers.

The low density body of the present invention is preferably in the form of a sheet, a board or a molding.

DESCRIPTION OF EMBODIMENTS

The fine fibers used in the present invention are usually natural fibers, synthetic high-molecular fibers and semi-synthetic high-molecular fibers, or those suitably treated by a mechanical or chemical method. It is important that these fine fibers have a bond-reinforcing factor of at least 0.15.

The natural fibers include unbleached or bleached chemical pulps obtained from softwood or hardwood by kraft-pulping, sulfite-pulping or alkali-pulping method; mechanical pulps such as GP (ground pulp), TMP (thermomechanical pulp), RMP (refiner mechanical pulp) and CTMP (chemithermomechanical pulp); pulp fibers such as cotton pulp, linter pulp and secondary paper pulp; cellulose fibers such as bacteria cellulose; protein fibers such as wool, silk and collagen fibers; and w composite polysacchride chain fibers such as chitin/chitosan fibers and alginic acid fibers. The synthetic high-molecular fibers include those synthesized from monomers, such as aliphatic polyester fibers, polyethylene fibers, polypropylene fibers and aramid fibers. The semi-synthetic high-molecular fibers include those obtained by chemically modifying natural products, such as acetylcellulose fibers.

Among these fine fibers, biodegradable fibers such as cellullose fibers, aliphatic polyester fibers and acetyl cellulose fibers are preferred. From the viewpoints of the stable feeding of the starting materials and the cost, preferred cellulose fibers are unbleached or bleached chemical pulps obtained from softwood or hardwood by kraft-pulping, sulfite-pulping or alkali-pulping method; mechanical pulps such as GP, RMP, CTMP and TMP; pulp fibers such as cotton pulp, linter pulp and waste paper pulp; and fibers obtained by further treating them.

In the present specification, the term "fine fibers" means that the fibers have an average width of 0.1 to 100 $\mu$m, preferably 0.1 to 50 $\mu$m.

The fine fibers preferably used in the present invention are those obtained by a mechanical treatment. The fibers in a branched shape have a remarkable effect of improving the internal bond strength and are easily obtained by the mechanical treatment. From the viewpoints of the effect of increasing the internal bond strength and easiness of the production, particularly preferred fine fibers are fine fiber pulps obtained by mechanically treating pulp fibers in a condition.

The above-described fine fibers can be used alone or in combination of two or more of them.

The bond-reinforcing factor (BF) herein is calculated according to the formula:

$$(E2-E1)/E1$$

wherein E1 represents an ultrasonic modulus of elasticity determined after mixing 50% by weight of a bleached kraft pulp of hardwood with 50% by weight of a bleached kraft pulp of softwood to obtain an aqueous slurry, beating the slurry to obtain a Canadian standard freeness (CSF) of 500 ml, dewatering the slurry with a handsheets machine for pulp test, air-drying the resultant product, heat-treating it at 130° C. for 1 minute to obtain a sheet having a basis weight of 60 g/m$^2$, and controlling the humidity at 65% RH at 20° C.; and E2 represents an ultrasonic modulus of elasticity determined in the same manner as that of E1 except that 50% by weight of the mixed, beaten pulp fibers were replaced with fine fibers in the preparation of the aqueous slurry.

The mechanical treatments include, for example, treatment with a medium-stirring mill (J. P. KOKAI No. Hei 4-18186), treatment with a vibration mill (J. P. KOKAI No. Hei 6-10286), treatment with a high-pressure homogenizer, treatment with a colloid mill and treatment with beating machines widely used in pulp and paper industry. The apparatus for the treatment is not particularly limited in the present invention.

With the medium-stirring mill or vibration mill, among the above-described machines, fibers which are softer than those obtained with another apparatus, are easily obtained, and the fibers become finer not only in the longitudinal direction but also three-dimensionally. The fine fibers thus obtained are particularly preferred because they are capable of efficiently and firmly bonding the curled fibers used in the present invention.

In the medium-stirring mill, a stirrer is inserted into a pulverizing vessel filled with glass beads, alumina beads or the like, and is rotated at a high speed to finely divide the fibers in the slurry by the shear stress. The medium-stirring mills include those of column-type, tank-type, tube-type and annular type. In the vibrating mill, the vessel is vibrated at a high speed to apply an impact force, shearing force or the like to the fibers dispersed in the slurry by the beads, balls, rods or the like in the container. In the high-pressure homogenizer, the slurry is passed through an orifice of a small diameter under a high pressure to finely divide the fibers in the slurry.

The present invention is characterized by using the fine fibers having a bond-reinforcing factor of at least 0.15. By using the fine fibers having a bond-reinforcing factor of at least 0.15, the innerlayer peeling and the formation of edge dust can be remarkably prevented and the intended low density body can be obtained. When fibers having a bond-reinforcing factor of below 0.15 are used, the bonding of the curled fibers with each other is insufficient, and the innerlayer peeling and the formation of edge dust cannot be inhibited in the obtained low density body, which is practically unsuitable.

The fine fibers having a bond-reinforcing factor in the range of 0.15 to 1.5 are preferred, and those in the range of 0.20 to 1.5 are much preferred. Although those having a bond-reinforcing factor of above 1.5 are usable as a matter of course from the viewpoint of the quality, the production cost of the fine fibers may be increased in such a case.

Although the size of the fine fibers obtained by the mechanical treatment of the pulp fibers and used in the present invention is not particularly limited, those having an arithmetic-average fiber length in the range of 0.01 to 0.80 mm are preferred. From the viewpoints of the yield and dispersibility, those having an arithmetic-average fiber length in the range of 0.05 to 0.60 mm are particularly preferred.

The fibers may have various shapes. They include, for example, fibers a major part of which comprises thin fibers, and fibers which are partially fibrilled to form partially thin fibers dispersed therein.

Therefore, the width of the fibers, which varies depending on the kind of the fibers and treating method, is usually preferably 0.1 to 30 $\mu$m. However, the width of the fibers are not particularly limited in the present invention.

The fine fibers of the present invention are those having a water retention value preferably in the range of 150 to 500%, still preferably 165 to 500%, and particularly 210 to 450%. When the water retention value is below 150%, the bonding power of the fibers is apt to be insufficient for bonding the curled fibers with one another. A low density body obtained from the combination of fine fibers having such a low water retention value and the curled fibers is inclined to have an insufficient internal bond strength and to form edge dust. Particularly when the low density body is in the form of a sheet, the paper strength is insufficient and the sheet is even unusable in some cases. On the contrary, when the water retention value exceeds 500%, the production cost of the fine fibers may be increased.

The water retention value (WRV) is defined to be the percentage (%) of water retained on the fibers based on the bone dry weight of the fibers thereof after contrifugal dewatering under the conditions of a centrifugal force of 3,000 G for 15 minutes, according to JAPAN TAPPINo. 26–78. The water retention value relates the relative amount of the hydroxyl groups (—OH) in the cellulose fibers, namely, the capacity of the hydrogen bonding in the fibers.

The curled fibers are those deformed by curling or twisting, the deformation of which is fixed with a chemical bond formed by a crosslinking reaction. The apparent length of the curled fibers is shorter than the original length. The curled fibers having a wet curl factor in the range of 0.4 to 1.0, preferably 0.5 to 1.0, are used in the present invention.

When the wet curl factor of the curled fibers is below 0.4, the bulkiness is low and the density of the low-density material obtained by the combination thereof with the fine fibers becomes high. On the contrary, when the wet curl factor of the curled fibers is above 1.0, the formation of edge dust becomes serious unfavorably because the fiber strength is lowered by the damage of the pulp fibers caused by the increase in mechanical force necessitated for deforming the pulp fibers, though the effect of increasing the bulkiness is obtained.

The wet curl factor is an index showing the degree of the deformation of the wet fibers. It is determined by immersing the curled fibers in pure water at room temperature for 24 hours and then metering the linear length (LA) of the fibers and the maximum projection length of the fibers (the length of the longest side of the rectangle surrounding the fiber; LB) with a microscope and calculating the value according to the following formula:

$$(LA/LB)-1.$$

This value numerically represents the degree of the curling as compared with the original length of the straight fiber.

A reason why the wet curl factor showing the curling state in the wet condition is important is that when the wet curl factor is low, the curled fiber is uncurled under a wet condition even when the curl factor of the dry fiber is very high and, therefore, a low density cannot be easily obtained. The curled fibers having a wet curl factor in the range of 0.4 to 1.0 are bent by deforming the pulp fibers to a considerable extent and crosslinked in themselves. Accordingly, the fibers are rigid and, therefore, a product obtained by preparing a slurry containing only these fibers, dewatering the slurry and drying the resultant product has a low density. However, in a low density body made from only curled fibers, the interlacing of the fibers is weak. In addition, in such a case, since the hydroxyl groups (–OH) in the cellulose molecule are reduced in number by the crosslinking treatment, the formation of the hydrogen bonds by the hydroxyl groups becomes difficult. As a result, the innerlayer peeling of the obtained product is serious and the product becomes impractical. The curled fibers are, therefore, combined with the specified fine fibers in the present invention.

The curled fibers are preferably those having a water retention value, i.e., capacity of retaining water, in the range of 10 to 80%, particularly in the range of 25 to 60%. When the water retention value is below 10%, the number of the hydroxyl groups (—OH) in the cellulose molecule is too small to obtain a strong fiber-to-fiber bond, and the low density body thus obtained is inclined to have a poor shape retention. When the curled fibers having a water retention value of above 80% are used, the curled fibers become straight in a short period of time under a wet condition to make the stable production of the low density body impossible. However, the water retention value of the curled fibers of the present invention is not limited to this range because products usable for some purposes can be obtained even when the water retention value thereof is not within this range.

The inventors have succeeded in developing the present invention on the basis of the finding that the materials having well-balanced low density and strength which could not be obtained by the combination of the curled fibers with another binder can be obtained by combining the curled fibers with the specific fine fibers.

As the curled fibers, those well known in the art are usable in the present invention. They include, for example, crosslinked fibers having an average water retention value of 28 to 50% obtained by internally crosslinking cellulose fibers with a $C_2$ to $C_8$ dialdehyde or an acid functional group-containing $C_2$ to $C_8$ monoaldehyde (J. P. KOKONU No. Hei 5-71702); crosslinked fibers having a water retention value of 25 to 60% obtained by internally crosslinking the cellulose fibers with a $C_2$ to $C_9$ polycarboxylic acid (J. P. KOKAI Nos. Hei 3-206174, 3-206175 and 3-206176); and crosslinked fibers available on the market such as those of trade names of HBA-FF, NHB 405 and NHB 416 (products of Weyerhaeuzer Co., U.S.A.). The crosslinked fibers are thus suitably selected.

After adding the crosslinking agent to the pulp fibers, the obtained mixture is mechanically stirred, then fluffed, heated and kept while the fibers are kept deformed to obtain the curled fibers having a high wet curl factor.

The mixing ratio of the curled fibers to the fine fibers can be suitably selected depending on the purpose so as to control the balance of the density with the internal bond strength in the present invention.

Namely, when greater importance is placed on the internal bond strength than to the low density, the relative amount of the fine fibers is increased and, on the contrary, when greater importance is placed on the low density than to the internal bond strength, the relative amount of the curled fibers is increased. The balance between the density and the internal bond strength is particularly excellent and desirable when 3 to 65% by weight, preferably 3 to 50% by weight of the fine fibers, based on the bone dry weight of the total weight of the fine fibers and curled fibers are mixed with 35 to 97% by weight, preferably 50 to 97% by weight, based on the same, of the curled fibers. Although the mixture of them in another mixing ratio is usable for some limited purposes, the internal bond strength of the low density body may be insufficient and paper dust may be easily formed when the amount of the fine fibers is below 3% by weight. On the contrary, when the fine fiber content exceeds 65% by weight, the density easily becomes excessively high.

The low density body of the present invention may contain, in addition to the above-described, specific curled fibers and fine fibers, additives suitably selected from among natural pulp fibers, organic synthetic fibers, inorganic fibers, paper strength additives, water-proofing agents, water-repellent, foaming microcapsules, sizing agents, dyes, pigments, yield-improving agents, fillers, pH-controlling agents, slime-controlling agents, flowability control agents, antiseptics, mildew-proofing agents, flame-retardants, antimicrobial agents, rodenticides, moth-proofing agents, humectants, freshness-preserving agents, oxygen-removing agents, microcapsules, foaming agents, surfactants, electromagnetic sielding agents, antistatic agents, corrosion inhibitors, aromatics and deodorants. These additives are usable either alone or in combination of two or more of them.

The natural pulp fibers include, for example, chemical pulps obtained from softwood and hardwood; mechanical pulps such as GP, RMP, TMP and CTMP, secondary pulps, cotton pulps and linter pulps. These pulps may be either bleached or unbleached, and either beaten or not beaten. The rigidity of these pulps may be increased by a chemical treatment. Mercerized pulps and other swollen pulps such as pulps treated with liquid ammonia may be used. The effect of chemically treated fibers for reducing the density is more excellent than that of fibers which are not chemically treated. They are used either alone or in the form of a combination of two or more suitably selected pulps. The amount of the pulp fibers which varies depending on the use of the low density body is usually preferably in the range of 0 to 60% by weight based on the whole solid components.

The organic synthetic fibers include, for example, polyethylene fibers, polypropylene fibers, polyacrylonitrile fibers, acrylic fibers, rayon fibers, polyester fibers and polyamide fibers. In them, biodegradable fibers such as aliphatic polyester fibers and acetyl cellulose fibers are particularly preferred. As for the shape of the fibers, curled fibers are preferred to the straight fibers because the effect of the former for reducing the density can be expected more than that of the latter. They are usable either singly or in a combination of two or more of them as suitably selected. The amount of the organic synthetic fibers, which varies depending on the use of the low density body, is usually in the range of 0 to 30% by weight based on the whole solid components. The organic synthetic fibers thus added are effective in improving the strength of the low-density material wet with water.

The inorganic fibers include, for example, glass fibers, carbon fibers, active carbon fibers, alumina fibers, silicon carbide fibers, silica/alumina silicate fibers and rock wool fibers. They are usable either alone or in combination of two or more of them selected suitably. The amount of the inorganic fibers which varies depending on the use of the low-density material, is usually in the range of 0 to 30% by weight based on the whole solid components. The inorganic synthetic fibers thus added are effective in imparting thermal resistance and various functions such as deodorizing effect and conductivity to the low density body.

The paper strength additives include, for example, starch, CMC, PVA, urea/formaldehyde resin, melamine/formaldehyde resin, polyamide/urea/formaldehyde resin, ketone resin, polyamide/epichlorohydrin resin, polyamide/polyamine/epichlorohydrin resin, glycerol/polyglycidyl ether resin and polyethyleneimine resin. They are usable either alone or in combination of two or more of them selected suitably. The addition amount of the paper strength improving agent, which varies depending on the use of the low density body, is usually in the range of 0 to 10% by weight based on the whole solid components. The paper strength improving agent thus added is usually effective in improving the strength. Particularly, a wet paper strength improving agent is very effective in improving the wet strength of the low density body.

The water-proofing agents include the above-described paper strength additives which are usable also as the water-proofing agents, as well as aldehyde group-containing formaldehyde, glyoxal and dialdehyde starch, and zirconium ammonium carbonate which is a polyvalent metal compound. The water-repellents include various waxes (such as natural wax, petroleum wax, chlorinated paraffin and wax emulsion), higher fatty acid derivatives, synthetic resins, chromium complex salts, zirconium salts and silicone resins. The water-repellents are not limited to them. They are usable either alone or in combination of two or more of them selected suitably. The water-proofing agent and the water-repellent are effective in improving the water resistance of the low density body. The amount of them which varies depending on the use of the low density body, is usually in the range of 0 to 10% by weight based on the whole solid components.

The foaming microcapsules usable in the present invention comprise, for example, fine resin particles containing a low boiling point solvent therein and having an average particle diameter of 5 to 30 $\mu$m. When the particles are heated to 70 to 150° C., they are swollen to 3 to 5 times as long diameter and 30 to 120 times as much volume. The resins are usually thermoplastic resins comprising copolymers of vinylidene chloride, acrylonitrile, an acrylic ester or a methacrylic ester. The low boiling solvent usually includes isobutane, pentane, petroleum ether, hexane and low boiling point halogenated hydrocarbons. They are usable either alone or in combination of two or more of them selected suitably. The amount of the foaming microcapsules, which varies depending on the use of the low density body, is usually in the range of 0 to 30% by weight based on the whole solid components. The foaming microcapsules are foamed by heat in the drying step to further reduce the density.

The slurry used for forming the low density body of the present invention is prepared either batchwise or continuously with an apparatus having a stirrer. The curled fibers are desirably not left to stand in the wet state for a long period of time. They are desirably macerated and mixed with the fine fibers immediately before the production of the low density body for the following reasons: although the hydrophilic properties of the curled fibers are weaker than those of ordinary pulps, the curled fibers absorb water to make the fibers by themselves soft when they are immersed in water for a long period of time and, as a result, the density of the low density body is increased and a high bulkiness thereof is not easily obtained. Therefore, the slurry is preferably prepared not by the batchwise method, but by the continous method wherein the slurry preparation can be controlled suitably for the production of the low density body. The medium for forming the slurry is usually water. Other media such as a mixture of water and an alcohol (e.g., methanol or ethanol), and organic solvents such as alcohols, acetone, ethyl acetate and glycerol are also usable. The concentration of the slurry which varies depending on the apparatus for the production of the low density body is usually controlled so that the dry solid content thereof is in the range of 0.05 to 10% by weight. Generally, for example, when a paper machine is used, the concentration of the slurry is controlled so that the dry solid content thereof is in the range of 0.05 to 2% by weight.

An excessively high concentration is unsuitable for the homogeneous mixing of the curled fibers and the fine fibers together with other additives.

The low density body of the present invention has advantages in that unlike the dry method, the fibers can be homogeneously mixed and the fiber-to-fiber bonding strength with the hydrogen bonds is increased to make the amount of the formed edge dust extremely small because the low density body is obtained by the slurry method or, in other words, so-called wet method wherein the medium is used.

The low density body of the present invention is in the form of, for example, a sheet, a board or a molding. The sheet can be prepared by an ordinary paper machine such as cylinder paper machine, fourdrinier paper machine, inclined former or twin-wire paper machine. The thickness of the sheet prepared with such a paper machine is usually 30 $\mu$m to 5 mm. The density of the sheet thus obtained varies depending on the kinds and relative amounts of the curled fibers and fine fibers and also on the kinds and relative amounts of the additives. Another factor is the pressure applied to the sheet in the course of the production thereof. To obtain a density as low as possible, various techniques are useful. For example, the degree of vacuum in the suction roll is made as low as possible in order to reduce the dewatering pressure in the wire part; the pressure of the dandy roll is made as low as possible; the pressing pressure is lowered in the press part; the tension of a dryer canvas and the pressing pressure of the size press are reduced; and an on-machine calender is not used. In the present invention, the body having a density in the range of 0.05 to 0.45 g/cm$^3$, preferably 0.05 to 0.25 g/cm$^3$ can be obtained by suitably controlling the composition of the slurry and selecting the techniques in the production.

The low density body thus obtained is usable as it is or, after a post-treatment such as the surface coating or impregnation, as a wood-free paper, light weight coat, art paper, coated paper, base paper for a thermosensitive recording paper, base paper for a thermal transfer receiving paper, base paper for a sublimation thermal transfer receiving paper, base paper for a pressure-sensitive copying paper, base paper for a paper cup, base paper for a laminate paper, base paper for metal vapor deposition, electrophotographic copying paper, wrapping paper or fancy paper. When the surface smoothness is required of the base paper, a Yankee dryer is preferably used in the dryer part. When a low density is required of the coated paper, the paper is desirably coated with a low density coating color such as a plastic pigment or a foamed color with fine foams. A post-treatment (including the on-machine treatment) with an adhesive-containing color coating is also effective for strengthening the sheet.

The low density boards of the present invention are those having a thickness of usually 5 mm to several centimeters. This board can be prepared with the paper making machine described above with reference to the low density sheet. By using a selected apparatus, wet, thin sheets of paper can be put together to form a thick laminate. The density of the board can be in the range of 0.05 to 0.45 g/cm$^3$ like that of the sheet by specially controlling the composition of the slurry and selecting the producing technique. Another, special production process such as a so-called injection method, comprises extruding the slurry into a box-like vessel made from screen at a high temperature under a high pressure to form a board. When starch having a high amylose content is added to the slurry, the product has a further reduced density.

The low density board thus obtained is usable in various fields of in which foamed styrene, foamed urethane or the like has been used, for example, construction material, packaging material and material for the ceiling of a motorcar, taking advantage of light weight, heat-insulating properties, cushioning properties, soundproofing properties, hygroscopicity, biodegradability, etc.

Two or more sheets or boards obtained as described above can be put together to form a thicker sheet or board.

The low density molding of the present invention may have a desired shape as prepared by a pulp molding method or injection method. The low density moldings having a density in the range of 0.05 to 0.45 g/cm$^3$ can be obtained by suitably selecting the composition of the slurry, suction pressure, extrusion pressure, etc. The moldings can be produced also by cutting the sheet or board into a desired size and pasting them together, or by cutting a block obtained by pasting the sheets or boards together, with a lathe.

The methods for incorporating the paper strength additives, water-proofing agents, water-repellents, antiseptics, mildew-proofing agents, flame-retardants, antimicrobial agents, rodenticides, moth-proofing agents, humectants, freshness-preserving agents, oxygen-removing agents, electromagnetic sielding agents, antistatic agents, corrosion inhibitors, aromatics, deodorants, etc. into the low density body include an internal addition method wherein they are mixed in the slurry as described above and also an external method wherein the surface of the sheet, board or molding is coated with them. The external method can be conducted by coating, brushing, spraying or the like. As a matter of course, the combination of the internal addition method with the external addition method may be employed.

The low density body thus obtained is usable in various fields in which foamed styrene, foamed urethane or the like has been used, for example, packaging material, impact-absorbing material for helmets, soundproofing material and heat insulating material, taking advantage of light weight, heat-insulating properties, cushioning properties, soundproofing properties, hygroscopicity, biodegradability, etc. The low density body of the present invention can be used also in combination with another material by interposing or applying it in or to a corrugated board or a paper board.

The low density body of the present invention which is highly permeable to a gas or a liquid is also usable as a filter. For example, a sheet or board made of this body is usable as a filter for automobiles, filter for vacuum cleaners, air filter, filter for air conditioners, filter for ventilation fans or paper for paper sliding doors. A molding made of this body is usable as a filter of cigarets. When a functional material such as a catalyst, active carbon or active carbon fibers is incorporated into the fibers, a filter having a special function like deodorizing function can be obtained.

The screens used for dewatering the slurry in a paper making machine or pulp-molding machine may be ordinary screens of 60 mesh or 80 mesh size. When the fine fibers are very fine or when the slurry concentration is low, a fine screen of 150 mesh or above is also properly usable.

The production machines usable in the present invention are not limited to those described above, and the uses of the obtained low density body are also not limited.

The following Examples will further illustrate the present invention, which by no means limit the scope of the present invention. Parts and percents in the following Examples and Comparative Examples are given by weight (parts by weight of the solid and % by weight, respectively) unless otherwise stated.

EXAMPLE 1

A solultion of 2 g of epichlorohydrin (a product of Wako Pure Chemical Industries, Ltd.) in 20 ml of isopropanol and 20 ml of a 5% sodium hydroxide solution and water were added to 50 g (absolute dry weight) of bleached conifer kraft pulp. Water was further added to the obtained mixture to make the total quantity 250 g. After thoroughly stirring, the mixture was fed into a 1 l double-arm kneader (type: S1-1, a product of Moriyama Seisakusho) and stirred with the double arms at 60 rpm and 100 rpm, respectively, at room temperature for 20 minutes. Then, the mixture was fed into a heat-resistant plastic bag, the bag was tightly closed and the mixture was heat-treated at 80° C. for 2 hours to conduct the crosslinking. Then, the alkali remaining in the pulp was thoroughly washed off with water. After the concentration to a solid content of 20% with Buchner funnel, the fibers were thoroughly disentagled and dried in an airdryer at 150° C. for 2 hours. The dry pulp was taken out of the dryer and cooled. The pulp masses were macerated and fluffed with an experimental Warburg blender. The curled fibers thus obtained had a wet curl factor of 0.75 and a water retension of 30%.

350 ml/min of an aqueous slurry of a bleached kraft pulp of a broadleaf tree, having a solid concentration of 1%, was passed through a 1.5 l DYNO-MILL (KDL-PILOT type; a product of Willy A. Bachofen) containing 80% by volume of glass beads having an average diameter of 2 mm to obtain fine fibers having an arithmetic-average fiber length of 0. 28 mm and a bond-reinforcing factor of 0.52. The water retention value of the fine fibers was determined to find that it was 280%.

90 parts of the curled fibers and 10 parts of the fine fibers obtained as described above were mixed together. Water was added to the mixture to control the solid concentration at 2%. After thorough stirring, a fiber slurry was obtained. The slurry was used as the stock. A wet sheet having a basis weight of 60 g/m$^2$ was formed on a wire with a square (250 mm×250 mm) handsheets machine provided with a 80 mesh bronze wire. After couching, no wet pressing was performed and the sheet was fixed in a frame and dried in a hot air dryer at 105° C. to obtain a sheet. The properties of the sheet were determined and the formation of edge dust was examined. The results are shown in Table 1.

The description will be made on the methods of evaluating the characteristic properties of the fine fibers and curled fibers used and the obtained sheets.

EVALUATION METHOD

[Method of determining bond-reinforcing factor]

50 parts of the bleached kraft pulp of hardwood was mixed with 50 parts of the bleached softwood kraft pulp. The concentration of the mixture was controlled at 2%, and the mixture was beaten with an experimental Niagara beater (capacity: 23l) until a Canadian standard freeness (CSF) had reached 500 ml. 3.7 g (absolute dry weight) of the obtained stock was taken and used for forming a sheet with a square (250 mm×250 mm) hand sheeting machine provided with a 150 mesh wire without adding any chemicals. After the couching followed by the wet press under 3.5 kg/cm$^2$ by an ordinary method for 5 minutes (first press) and then for 2 minutes (second press), the sheet was fixed in a frame and dried with an air dryer at ambient temperature. After the heat treatment at 130° C. for 2 minutes, a sheet 1 having a basis weight of 60 g/m$^2$ was obtained. The sheet was controlled at 65% RH at 20° C.

On the other hand, 3.7 g (absolute dry weight) of the stock obtained by thoroughly mixing 50 parts of the beaten hardwood and softwood mixed pulp with 50 parts of the fine fibers was taken, and a sheet 2 was prepared in the same manner as that described above, and the sheet was controlled at 65% RH at 20° C.

The density of each of the sheets 1 and 2 was determined, and then the modulus of elasticity (GPa) of each of the sheets 1 and 2 was determined by determining the ultrasonic propagation velocity with a dynamic Young's modulus meter (SST-210 A; a product of Nomura Shoji Co., Ltd.). The modulus of elasticity (E) was calculated according to the following formula:

$$E(\text{GPa})=\rho(g/\text{cm}^3)\times[S(\text{km}/s)]^2$$

wherein ρ represents the density (g/cm$^3$) of the sheet having the controlled humidity, and S represents the ultrasonic propagation velocity (km/s).

The bond-reinforcing factor is represented by [(E2/E1)−1] wherein E1 (GPa) represents the modulus of elasticity of the sheet 1, and E2 (GPa) represents the modulus of elasticity of the sheet 2.

[Method of determination of arithmetic-average fiber length]

The arithmetic-average fiber strength was determined with KAJAANI fiber-length measuring equipment (type: FS-200).

[Method of determining water retention value]

The water retention value was determined according to JAPAN TAPPI No. 26-78.

When the curled fibers were in dry state, the water retention value was determined as follows: 0.5 g (absolute dry weight) of the stock was completely dispersed in 100 ml of distilled water. The dispersion was left to stand at room temperature for 24 hours to thoroughly impregnate the fibers with water. The stock was collected on a filter, then fed into a container of a centrifuge (type: H-103N, a product of Kokusan Enshinki Co.) having a G2 glass filter and centrifuged for 15 minutes. The centrifugal force was 3000 G.

The centrifuged sample was taken out of the container, and the wet sample thus obtained was weighed. Then, the sample was dried in a dryer at 105° C. until the weight thereof had become constant. The dry weight was determined, and the water retention value was calculated according to the following formula:

$$\text{Water retention value (\%)}=[(W-D)/D]\times 100$$

wherein W represents the weight (g) of the wet sample after the dewatering by the centrifugation, and D represents the weight (g) of the bone bried sample.

The water retention value of the fine fibers was determined by controlling the solid concentration thereof in the range of 6 to 9%, taking 0.7 g (absolute dry weight) of the sample, feeding the sample into a container having a G3 glass filter, dewatering it by the centrifugation in the same manner as that described above, and calculating the water retention value from the wet weight and the dry weight according to the above formula.

[Method of determining wet curl factor]

100 curled fibers immersed in distilled water at room temperature for 24 hours were placed on a slide glass for a microscope. The actual (linear) length LA (μm) and the maximum projection length LB (μm) (which is equal to the length of the longest side of the rectangle surrounding the fiber) of each fiber were determined with an image analyzer, and the wet curl factor was determined according to the following formula, and the mean value thereof was calculated:

$$\text{Wet curl factor}=(LA/LB)-1$$

[Properties of sheet]

The basis weight of the obtained sheet was determined according to JIS P 8142; the thickness and density thereof were determined according to JIS P 8118; and the tensile strength (breaking length) thereof was determined according to JIS P 8113.

[Method of determining internal bond strength]

The internal bond strength was determined according to TAPPI 541 om.

[Formation of edge dust in cutting sheet or molding]

The sheet or molding was cut with a commercially available cutter knife (trade name: NT Cutter L-500), and the degree of the formation of edge dust was macroscopically determined according to the following criteria:

◎: Edge dust was scarcely formed.

○: Edge dust was only slightly formed to cause no practical problem.

Δ: Edge dust was considerably formed to cause a practical problem.

X : A large amount of edge dust was formed, and the sheet or molding was unsuitable for use.

When the determination was impossible, the results were shown by "-".

EXAMPLE 2

An aqueous slurry of a bleached kraft pulp of a broadleaf tree having a solid concentration of 1% was treated with a 6-cylinder sand grinder (capacity: 300 ml, a product of Aimex Co.) filled with glass beads having an average particle diameter of 2 mm to obtain fine fibers having an arithmetic-average fiber length of 0.18 mm and a bond-reinforcing factor of 1.15. The fine fibers had a water retention value of 400%.

10 parts of the fine fibers were mixed with 90 parts of the curled fibers obtained in the same manner as that of Example 1, and the mixture was diluted with water to a solid concentration of 2% and then stirred to obtain a fully dispersed fiber slurry. The same procedure as that of Example 1 was repeated except that the resultant slurry was used as the stock to obtain a sheet having a basis weight of 60 g/m$^2$. The results of the evaluation are shown in Table 1.

EXAMPLE 3

An aqueous slurry of a bleached kraft pulp of hardwood having a solid concentration of 3% was repeatedly treated with a 12-inch single-disk refiner (a product of Kumagai Riki Kogyo Co.) to obtain fine fibers having a CSF of 200 ml. The fine fibers had an arithmetic-average fiber length of 0.35 mm, bond-reinforcing factor of 0.17 and water retention value of 160%.

10 parts of the fine fibers were mixed with 90 parts of the curled fibers obtained in the same manner as that of Example 1, and the mixture was diluted with water to a solid concentration of 2% and then stirred to obtain a fully dispersed fiber slurry. The same procedure as that of Example 1 was repeated except that the resultant slurry was used as the stock to obtain a sheet having a basis weight of 60 g/m$^2$. The results of the evaluation are shown in Table 1.

EXAMPLE 4

A sheet having a basis weight of 60 g/m$^2$ was prepared in the same manner as that of Example 1 except that a stock obtained by mixing 75 parts of curled fibers with 25 parts of fine fibers was used. The results of the evaluation are shown in Table 1.

EXAMPLE 5

A sheet was prepared in the same manner as that of Example 1 except that the fine fibers obtained by the treatment with DYNO-MILL was replaced with 10 parts of commercially available aramid fine fibers (trade name: KY-400M; a product of Daicel Chemical Industries, Ltd.) having an arithmetic-average fiber length of 0.15 mm and a bond-reinforcing factor of 0.25. The fine fibers had a water retention value of 288%. The results of the evaluation are shown in Table 1.

EXAMPLE 6

A sheet having a basis weight of 60 g/m$^2$ was prepared in the same manner as that of Example 1 except that the wet sheet prepared by the handsheets machine was wet-pressed under 3.5 kg/cm$^2$ in an ordinary method. The results of the evaluation are shown in Table 1.

EXAMPLE 7

450ml/min of an aqueous slurry of hardwood kraft pulp, having a solid concentration of 1%, was passed through a 1.5 l-vessel of DYNO-MILL containing 80% by volume of glass beads having an average diameter of 2 mm to obtain fine fibers having an arithmetic-average fiber length of 0.31 mm, bond-reinforcing factor of 0.43 and water retention value of 220%.

25 parts of the fine fibers were mixed with 75 parts of commercially available curled fibers (trade name: NHB 416, a product of Weyerhaeuser Co., U.S.A.). The mixture was diluted with water to a solid concentration of 2% and thoroughly stirred to obtain a fully dispersed fiber slurry. A sheet having a basis weight of 60 g/m$^2$ was prepared in the same manner as that of Example 6 except that the sheet prepared from the slurry thus obtained was used as the stock. The results of the evaluation are shown in Table 1.

EXAMPLE 8

A sheet having a basis weight of 60 g/m$^2$ was prepared in the same manner as that of Example 7 except that 0.5% (absolute dry basis), based on the fibers, of polyacrylamide resin (trade name: AF-100, a product of Arakawa Kagaku Kogyo) was added as the paper strength improving agent to the same stock as that used in Example 7. The results of the evaluation are shown in Table 1.

EXAMPLE 9

60 parts of commercially available curled fibers (trade name: NHB 416, a product of Weyerhaeuser Co., U.S.A.) were mixed with 20 parts of the fine fibers having an arithmetic-average fiber length of 0.28 mm, bond-reinforcing factor of 0.52 and water retention value of 280%, which was obtained in Example 1, and 20 parts of bleached softwood kraft pulp beaten with an experimental Niagara beater (capacity: 23 l) until the CSF had reached 650 ml. The mixture was diluted with water to a solid concentration of 2%, and thoroughly stirred to obtain a ci fully dispersed fiber slurry. A sheet having a basis weight of 60 g/m$^2$ was obtained in the same manner as that of Example 6 except that this slurry was used as the stock. The results of the evaluation are shown in Table 1.

COMPARATIVE EXAMPLE 1

It was tried to produce a sheet in the same manner as that of Example 1 except that only curled fibers were used for preparing the starting slurry without using the fine fibers. However, the wet paper sheet could not be removed from the wire, and the sheet could not be produced.

COMPARATIVE EXAMPLE 2

90 parts of curled fibers obtained in the same manner as that of Example 1 except that the treatment time with the kneader was changed to 60 minutes and having a wet curl factor of 1.1 and water retention value of 30% were mixed with 10 parts of the fine fibers beaten with the refiner as used in Example 3. The mixture was diluted with water to a solid concentration of 2%, and stirred to obtain a fully dispersed fiber slurry. A sheet having a basis weight of 60 g/m$^2$ was prepared in the same manner as that of Example 1 except that this slurry was used as the stock. The results of the evaluation are shown in Table 1.

COMPARATIVE EXAMPLE 3

A sheet having a basis weight of 60 g/m$^2$ was prepared in the same manner as that of Example 6 except that the stock used was a mixture of 75 parts of a bleached softwood kraft pulp which was not treated or deformed and which had a wet curl factor of 0.33 and a water retention value of 135%, with 25 parts of the same fine fibers as those used in Example 1 which had an arithmetic-average fiber length of 0.28 mm, bond-reinforcing factor of 0.52 and water retention value of 280%. The results of the evaluation are shown in Table 1.

COMPARATIVE EXAMPLE 4

Fine fibers having an arithmetic-average fiber length of 0.45 mm, bond-reinforcing factor of 0.13 and water retention value of 130% were prepared in the same manner as that of Example 3 except that a bleached hardwood kraft pulp was repeatedly beaten with a single-disk refiner to obtain a CSF of 350 ml.

A sheet having a basis weight of 60 g/m$^2$ was prepared in the same manner as that of Example 1 except that 10 parts of the fibers were used in place of the fine fibers obtained by the treatment with DYNO-MILL. The results of the evaluation are shown in Table 1.

EXAMPLE 10

A fully dispersed starting slurry was prepared by mixing 90 parts of commercially available curled fibers (trade name: NHB 416, a product of Weyerhaeuser Co., U.S.A.) having a wet curl factor of 0.65 and water retention value of 60%, with 10 parts of the same fine fibers as those used in Example 1, which had an arithmetic-average fiber length of 0.28 mm, bond-reinforcing factor of 0.52 and water retention value of 280%, and then diluting the obtained mixture with water to a solid concentration of 2%. 300 g (absolute dry weight) of the starting material was taken from the slurry and couched with the square handsheets machine which was the same as that used in Example 1 to form a wet board on the wire. The wet board was transferred onto a filter paper placed on a stainless steel plate having numerous pores having a diameter of 3 mm from the wire and directly dried in an air dryer at 105° C. After the completion of the drying followed by controlling the humidity at 65% RH at 20° C., the board had a weight of 310 g and a thickness of 55 mm.

A sheet having a size of 25 mm×25 mm and a thickness of 5 mm was cut from the wire-side of the board with a cutter knife, and edge dust formation and the internal bond strength were examined. The results are shown in Table 2.

The compression characteristics of the obtained board were evaluated from the Young's modulus, compression stress and permanent deformation. The results are also shown in Table 2. The determination methods are shown below.

[Compression characteristics]

Cubes having a size of 20 mm×20 mm×20 mm were cut from the obtained molding, i.e., board, with a cutter knife. The compression characteristics of the cubes were determined with a tensile strength tester (type: M2, a product of Toyo Seiki Seisakusho). In the test, a load cell of a capacity of 100 kg was used, and the compression rate was 20 mm/min.

Young's modulus was determined by preparing a graph wherein the the deformation (%) was given as abscissae, and the compression stress (kgf/cm$^2$) was given as ordinates, and calculating the Young's modulus from the inclination of the straight portion at the start of the curve.

The permanent deformation was also calculated as follows: the compression stress (kgf/cm$^2$) caused by 60% (12 mm) deformation was determined. The permanent deformation (%) was defined to be a value obtained by deforming the sample by 75% (15 mm), leaving the sample to stand for 24 hours and calculating the ratio of the deformation to the original height (20 mm). The permanent deformation was calculated according to the following formula:

$$\text{Permanent deformation (\%)}=[\text{deformation(mm)/original height (mm)}]\times 100$$

EXAMPLE 11

A board was prepared in the same manner as that of Example 10 except that the slurry was replaced with a slurry obtained by mixing 40 parts of fine fibers having an arithmetic-average fiber length of 0.33 mm, bond-reinforcing factor of 0.23 and water retention value of 170%, which was obtained in the same manner as in Example 3 except that the bleached hardwood kraft pulp was repeatedly beaten with the refiner until CSF had become 120 ml, with 60 parts of the commercially available curled fibers which were the same as those used in Example 10.

After controlling the humidity, the board had a weight of 315 g and a thickness of 27 mm. The results of the evaluation are shown in Table 2.

EXAMPLE 12

A board was prepared in the same manner as that of Example 10 except that the starting slurry was replaced with a slurry obtained by mixing 50 parts of the commercial, curled fibers which were the same as those used in Example 11, with 25 parts of the same fibers beaten with the refiner as that used in Example 11 as the fine fibers, and 25 parts of the bleached softwood kraft pulp beaten to obtain a CSF of 650 mm, which was the same as that used in Example 9. After controlling the moisture, the board had a weight of 318 g and a thickness of 20 mm. The results of the evaluation are shown in Table 2.

COMPARATIVE EXAMPLE 5

Example 10 was tried to repeat except that 100% of curled fibers were used for preparing the starting slurry without using the fine fibers. However, part of the fibers remained on the wire when the wet board was peeled out of the wire.

The wet board was dried to control the moisture in the same manner as that of Example 10. However, when the fibers were pinched, they were peeled off, and it was impossible to cut the 5 mm sheet with a cutter knife.

COMPARATIVE EXAMPLE 6

A board was prepared in the same manner as that of Example 10 except that the starting slurry was replaced with a slurry obtained by mixing 60 parts of a bleached softwood kraft pulp having a wet curl factor of 0.33 and water retention value of 135%, which was the same as that used in Comparative Example 3, with 40 parts of the same fibers beaten with the refiner as that used in Example 11 and having an arithmetic-average fiber length of 0.33 mm, bond-reinforcing factor of 0. 23 and water retention value of 170% as the fine fibers and except that 700 g (absolute dry weight) of the stock was taken from the slurry.

After controlling the moisture, the board had a weight of 738 g and a thickness of 22 mm. The results of the evaluation are shown in Table 2.

COMPARATIVE EXAMPLE 7

A board was prepared in the same manner as that of Example 10 except that the starting slurry was replaced with a slurry obtained by mixing 10 parts of the same fine fibers as those used in Comparative Example 4, which were obtained by beating with a refiner and having an arithmetic-average fiber length of 0.45 mm, bond-reinforcing factor of 0.13 and water retention value of 130%, with 90 parts of the same commercial curled fibers as those used in Example 10. After controlling the moisture, the board had a weight of 324 g and a thickness of 58 mm. The results of the evaluation are shown in Table 2.

EXAMPLE 13

The same starting slurry as that used in Example 10 was prepared.

The starting slurry was thoroughly stirred, and then concentrated and dewatered to a solid concentration of about 5% by weight with a Buchner funnel having a diameter of 12 cm. The concentrate was then softly and uniformly pressed into a 50 mm×50 mm×50 mm open cubic vessel made of 80 mesh stainless wire with hand. The vessel was placed in a dryer of hot air circulation system at 105° C. and dried for 3 hours to obtain a molding. After controlling the moisture at 65% RH at 20° C., a piece having a thickness of 5 mm was cut from the wire-side of the molding. The internal bond strength and the formation of edge dust of the piece were examined. A cube having a size of 20 mm×20 mm×20 mm was also cut from the molding with a cutter knife, and the compression characteristics of the cube were evaluated in the same manner as that in the evaluation of the board. The results of the evaluation are shown in Table 2.

EXAMPLE 14

A molding was prepared in the same manner as that of Example 13 except that the same starting slurry as that used in Example 11 was used. The results of the evaluation are shown in Table 2.

EXAMPLE 15

A molding was prepared in the same manner as that of Example 13 except that the same starting slurry as that used in Example 12 was used.

The results of the evaluation are shown in Table 2.

COMPARATIVE EXAMPLE 8

Example 13 was repeated except that the same starting slurry as that used in Comparative Example 5 was used. The resultant molding was easy to lose its shape and it was impossible to obtain a sheet having a thickness of 5 mm by cutting it with a cutter knife.

COMPARATIVE EXAMPLE 9

A molding was prepared in the same manner as that of Example 13 except that the same starting slurry as that used in Comparative Example 6 was used. The results of the evaluation are shown in Table 2.

COMPARATIVE EXAMPLE 10

A molding was prepared in the same manner as that of Example 13 except that the same starting slurry as that used in Comparative Example 7 was used. The results of the evaluation are shown in Table 2.

COMPARATIVE EXAMPLE 11

A commercial, foamed polystyrene (density: 0.02 g/cm$^3$) was cut into 20 mm×20 mm cubes with a cutter knife, and the compression characteristics of the cubes were evaluated. The results are shown in Table 2.

The results of the evaluation of the sheets obtained in Examples 1 to 9 and Comparative Examples 1 to 4 are summarized in Table 1.

TABLE 1

| | Basis wt. (g/m$^3$) | Thickness (mm) | Density (g/cm$^3$) | Breaking length (km) | Edge dust | Internal bond strength (kg · cm/in$^2$) |
|---|---|---|---|---|---|---|
| Ex. 1 | 60.8 | 0.68 | 0.09 | 1.31 | ◎ | 0.72 |
| Ex. 2 | 59.5 | 0.54 | 0.11 | 1.51 | ◎ | 1.29 |
| Ex. 3 | 61.0 | 0.68 | 0.09 | 1.12 | ○ | 0.68 |
| Ex. 4 | 61.3 | 0.44 | 0.14 | 1.69 | ◎ | 1.43 |
| Ex. 5 | 62.0 | 0.69 | 0.09 | 1.12 | ○ | 1.17 |
| Ex. 6 | 61.2 | 0.32 | 0.19 | 1.98 | ◎ | 1.43 |
| Ex. 7 | 56.6 | 0.26 | 0.22 | 2.10 | ◎ | 1.62 |
| Ex. 8 | 60.3 | 0.27 | 0.22 | 2.50 | ◎ | 1.71 |
| Ex. 9 | 61.1 | 0.19 | 0.33 | 3.80 | ◎ | 1.64 |
| Comp. Ex. 1 | x | x | x | x | — | x |
| Comp. Ex. 2 | 60.4 | 0.76 | 0.08 | 0.48 | Δ | 0.39 |
| Comp. Ex. 3 | 61.3 | 0.13 | 0.48 | 3.92 | ◎ | 2.92 |
| Comp. Ex. 4 | 60.1 | 0.75 | 0.08 | 0.39 | x | 0.30 |

Note: x in the above table represents "unmeasurable".

The results of the evaluation of the boards and moldings obtained in Examples 10 to 15 and Comparative Examples 5 to 11 are summarized in Table 2.

TABLE 2

| | Density (g/m$^3$) | Young's modulus (kgf/cm$^3$) | Compression stress (kgf/cm$^3$) | Permanet deformation (%) | Edge dust | Internal bond strength (kg · cm/in$^2$) |
|---|---|---|---|---|---|---|
| Ex. 10 | 0.09 | 2.8 | 2.9 | 20 | ◎ | 0.78 |
| Ex. 11 | 0.19 | 15.9 | 7.8 | 25 | ◎ | 1.39 |
| Ex. 12 | 0.25 | 23.9 | 7.2 | 25 | ◎ | 1.38 |
| Ex. 13 | 0.09 | 2.8 | 2.8 | 20 | ◎ | 0.83 |
| Ex. 14 | 0.20 | 15.4 | 7.9 | 25 | ◎ | 1.51 |
| Ex. 15 | 0.24 | 25.3 | 8.0 | 25 | ◎ | 1.44 |
| Comp. Ex. 5 | x | x | x | x | — | x |
| Comp. Ex. 6 | 0.53 | 53.5 | 25.4 | 40 | Δ | 3.43 |
| Comp. Ex. 7 | 0.09 | 2.7 | 2.7 | 20 | x | 0.13 |
| Comp. Ex. 8 | x | x | x | x | — | x |
| Comp. Ex. 9 | 0.55 | 51.8 | 26.9 | 40 | Δ | 3.71 |
| Comp. Ex. 10 | 0.09 | 2.6 | 2.8 | 20 | x | 0.15 |
| Comp. Ex. 11 | 0.02 | 3.0 | 2.8 | 30 | — | — |

Note: x in the above table represents "unmeasurable".

It is clear from Table 1 that the low density sheets obtained in Examples 1 to 9 had a very low, satisfactory density and that they scarcely formed edge dust or, even when they formed edge dust, the amount thereof was only small and they were suitable for the practical use. As compared with Example 1, the density and internal bond strength can be controlled by changing the bond-reinforcing factor of the fine fibers (Examples 2 and 3), by changing the relative amounts of the components (Example 4) or by changing the wet pressing pressure (Example 6). Synthetic fibers such as aramide fine fibers are also usable as the fine fibers, or commercial curled fibers are also usable (Examples 5 and 7). The low density body of the present invention can also contain various chemicals. By adding a paper strength improving agent, the strength can be further improved while the density is kept unchanged (Example 8). The low density sheet of the present invention can contain a given amount of an ordinary pulp (Example 9). It is clear from the comparison of Examples 3 and 7 that, when fine fibers having a water retention value of at least 210% are used, edge dust is scarcely formed and a long breaking strength is obtained favorably.

On the other hand, even when it is tried to prepare a sheet, a board or a molding by using the curled fibers used in the present invention alone, the intended sheet cannot be obtained or the molding cannot retain its shape and very easily lose its shape because the fiber-to-fiber bonding power is weak (Comparative Example 1). When the curled fibers are replaced with a bleached softwood pulp, the desired low density body cannot be obtained (Comparative Example 3). It is also understood from the comparison of Comparative Example 2 with Example 3 that when curled fibers having an excessively high wet curl factor are used, edge dust is easily formed, and the internal bond strength is low and the breaking length is short, because the fibers become brittle, though the density can be further reduced. Also, when fine fibers having a bond-reinforcing factor of below 0.15 are used, the obtained product has a low internal bond strength and easily forms edge dust, because of the insufficient fiber-to-fiber bonding power (Comparative Example 4).

In addition, it is clear from Table 2 that, according to the present invention, the boards and moldings having a sufficiently low density and scarcely forming edge dust can be obtained because the internal bond strength is high (Examples 10 to 15). Judging from the characteristic properties such as Young's modulus, compression stress and permanent deformation, these low density bodies are sufficiently usable as cushioning materials. Particularly in Examples 10 and 13, the values of Young's modulus, compression stress and permanent deformation of the products were substantially the same as those of the foamed polystyrene (Comparative Example 11) and, therefore, they satisfy the conditions required of the cushining materials. Further, the density and strength can be controlled by varying the proportion of the curled fibers to the fine fibers (Examples 11 and 14) or by incorporating an ordinary pulp (NBKP) (Examples 12 and 15).

On the other hand, even when it is tried to prepare a board or a molding by using the curled fibers used in the present invention alone, the fiber-to-fiber strength of the fibers is weak as in the case of the sheet, and the molding cannot retain its shape and very easily lose its shape (Comparative Examples 5 and 8). When the curled fibers are replaced with softwood pulp, the desired low density body cannot be obtained, edge dust is easily formed and the permanent deformation is serious to make the practical use thereof as the cushioning material impossible (Comparative Examples 6 and 9). Also when fine fibers having a bond-reinforcing factor of below 0.15 are used, the obtained product has a low interlaminar strength and easily forms edge dust, because of the insufficient fiber-to-fiber bonding power (Comparative Examples 7 and 10).

As described above, the present invention has an effect of providing a low density body having a high internal bond strength to scarcely form edge dust, which body is usable as a cushioning material, heat-insulating material, sound-absorbing material, filter, low density base paper or the like. In addition, biodegradable fibers are used as fibers in the low density body, the body is useful for protection of environment.

What is claimed is:

1. A low density body having a density of 0.05 to 0.45 g/cm$^3$, comprising fine fibers having a bond-reinforcing factor of at least 0.15 and curled fibers having a wet curl factor of 0.4 to 1.0.

2. The body of claim 1 wherein said fine fibers have a bond-reinforcing factor of 0.15 to 1.5.

3. The body of claim 2 wherein said fine fibers have a bond-reinforcing factor of 0.20 to 1.5.

4. The body of claim 1 wherein said curled fibers have a wet curl factor of 0.5 to 1.0.

5. The body of claim 1 wherein said fine fibers have a width of 0.1 to 100 $\mu$m.

6. The body of claim 5 wherein said fine fibers have a width of 0.1 to 50 $\mu$m.

7. The body of claim 1 wherein said fine fibers and said curled fibers are biodegradable fibers.

8. The body of claim 7 wherein said biodegradable fibers are selected from the group consisting of cellullose fibers, aliphatic polyester fibers and acetyl cellulose fibers.

9. The body of claim 8, wherein said fine fibers are pulp fibers.

10. The body of claim 1, wherein said low density body is obtained by dewatering a slurry containing said fine fibers and said curled fibers and drying the resultant product.

11. The body of claim 1 having a density of 0.05 to 0.25 g/cm$^3$.

12. The body of claim 1 wherein said fine fibers are contained in an amount of 3 to 65% by weight based on the total weight of said fine fibers and said curled fibers.

13. The body of claim 12 wherein said fine fibers are contained in an amount of 3 to 50% by weight based on the total weight of said fine fibers and said curled fibers.

14. The body of claim 1, wherein said fine fibers have an arithmetic-average fiber length in the range of 0.01 to 0.80 mm.

15. The body of claim 14, wherein said fine fibers have an arithmetic-average fiber length in the range of 0.05 to 0.60 mm.

16. The body of claim 1, wherein said fine fibers have a water retention value of 150 to 500%.

17. The body of claim 16, wherein said fine fibers have a water retention value of 165 to 500%.

18. The body of claim 1 in the form of a sheet, a board, or molding.

19. The body of claim 1 further containing fibers selected from the group consisting of natural pulp fibers, organic synthetic fibers and inorganic fibers, said fibers being other than said fine fibers and curled fibers.

* * * * *